US011035569B2

(12) United States Patent
Curtis

(10) Patent No.: US 11,035,569 B2
(45) Date of Patent: Jun. 15, 2021

(54) CEILING FAN HAVING LIGHTED BLADES

(71) Applicant: Richard Barry Curtis, Haines City, FL (US)

(72) Inventor: Richard Barry Curtis, Haines City, FL (US)

( * ) Notice: Subject to any disclaimer, the term of this patent is extended or adjusted under 35 U.S.C. 154(b) by 0 days.

(21) Appl. No.: 16/700,819

(22) Filed: Dec. 2, 2019

(65) Prior Publication Data

US 2020/0393122 A1 Dec. 17, 2020

Related U.S. Application Data

(60) Provisional application No. 62/921,343, filed on Jun. 12, 2019.

(51) Int. Cl.

| | |
|---|---|
| ***F21V 33/00*** | (2006.01) |
| ***F21V 23/00*** | (2015.01) |
| ***F04D 29/00*** | (2006.01) |
| ***F04D 25/06*** | (2006.01) |
| ***F04D 25/08*** | (2006.01) |

(52) U.S. Cl.

CPC ..... *F21V 33/0096* (2013.01); *F04D 25/0693* (2013.01); *F04D 25/088* (2013.01); *F04D 29/005* (2013.01); *F21V 23/002* (2013.01); *F21V 23/003* (2013.01)

(58) Field of Classification Search

None

See application file for complete search history.

(56) References Cited

U.S. PATENT DOCUMENTS

| | | | | |
|---|---|---|---|---|
| 5,082,422 A * | 1/1992 | Wang | F04D 25/088 | 362/234 |
| 5,437,540 A * | 8/1995 | Blocker | F04D 25/088 | 310/232 |
| 6,036,331 A * | 3/2000 | Acquisto | F04D 29/005 | 362/96 |
| 9,901,039 B1 * | 2/2018 | Dellerson | A01G 9/26 | |

* cited by examiner

*Primary Examiner* — Michael Lebentritt
*Assistant Examiner* — Jason G Davis
(74) *Attorney, Agent, or Firm* — Cygnet IP Law, P.A.; Stephen W. Aycock II

(57) ABSTRACT

Described is a ceiling fan having lighted blades. The ceiling fan can include a power supply supplying electrical power via a negative lead and a positive lead, and a conductive frame connected to a down rod. The ceiling fan can also include a positive voltage plate and a positive voltage plate contact that contacts the positive voltage plate while the positive voltage plate rotates. The ceiling fan can further include one or more lights disposed on a fan blade connected to the power supply.

3 Claims, 2 Drawing Sheets

CEILING FAN HAVING LIGHTED BLADES

RELATED APPLICATIONS

This application claims the benefit of U.S. Application No. 62/921,343, entitled "Spinning Lights on Ceiling Fan," and filed on Jun. 12, 2019, which is incorporated herein by reference in its entirety.

FIELD

Some implementations relate generally to ceiling fans, and more particularly, to ceiling fans having lighted blades.

BACKGROUND

It may be desirable to provide a ceiling fans having lighted blades for interior or exterior illumination or for decorative or entertainment purposes. Some implementations were conceived in light of the above-mentioned limitations, needs, or problems, among other things. The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

DETAILED DESCRIPTION

Figure 1:
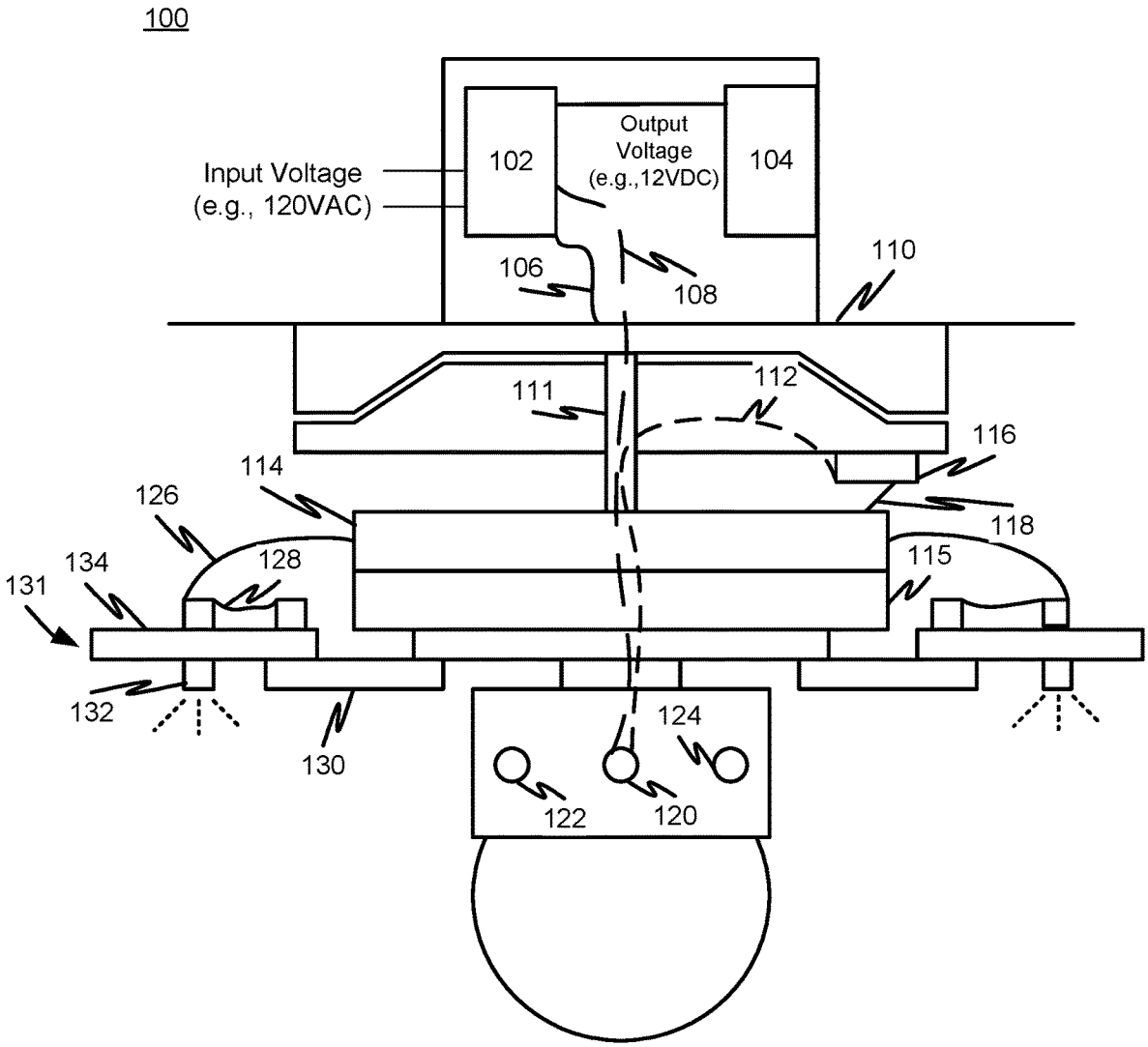
FIG. 1 is a diagram of an example ceiling fan having lighted blades in accordance with some implementations.

FIG. 1 is a diagram of an example ceiling fan 100 having lighted blades that includes a power supply 102 (e.g., a 120 VAC to 12 VDC 60 W transformer or power supply) constructed to supply direct current electrical power (e.g., 12 VDC) via a negative lead 106 and a positive lead 108. The ceiling fan 100 having lighted blades also includes a conductive frame 110, and where the negative lead 106 is connected to the conductive frame 110.

The ceiling fan 100 having lighted blades also includes a conductive positive voltage plate 114 and a conductive positive voltage plate contact 118 connected to the positive lead 108 (optionally via a switch 120). The positive voltage plate contact 118 is stationary and mounted to a positive voltage plate contact mounting bracket 116 that may be nonconductive so as to electrically insulate the positive voltage plate contact 118 from any conductive portions of the conductive frame 110. The positive voltage plate contact 118 contacts the positive voltage plate 114 while the positive voltage plate 114 rotates. As shown in FIG. 1, the conductive frame 110 is connected to the down rod 111.

The ceiling fan 100 having lighted blades also includes a rotating portion 115 having a conductive housing connected to down rod 111, the rotating portion 115 being coupled to the positive voltage plate 114 (e.g., via insulated bolts) and one or more conductive fan blade brackets 130 electrically connected to the negative lead 106 via the conductive housing of the rotating portion 115, wherein when the rotating portion 115 rotates, the positive voltage plates 114 rotates. The positive voltage plate 114 can be electrically insulated from the mounting bolts and the conductive housing of the rotating portion 115. The ceiling fan 100 includes one or more lighted blades 131 each having one or more lights 132 (e.g., light emitting diodes or LEDs) disposed on a fan blade 134, wherein each light 132 is connected to a respective conductive fan blade bracket 130 (via conductor 128) and to the positive voltage plate 114 (via positive conductor 126) such that a negative lead 106 of the direct current electrical power is supplied through the conductive fan blade bracket 130 and a positive side 108 of the direct current electrical power is supplied through the positive voltage plate 114. The fan can also include a fan switch 122 and/or a main light 136 switch 124.

The ceiling fan 100 having lighted blades can also include a control circuit 104 operable to control the one or more lights. For example, the control circuit 104 can include communications capabilities to communicate with a wireless device (e.g., to control the lights for on/off, brightness, color, blinking, etc.) or to respond to input such as music or sound to control lights in response to the input such as blinking the lights, changing brightness of the lights, or changing the color of the lights.

Figure 2:
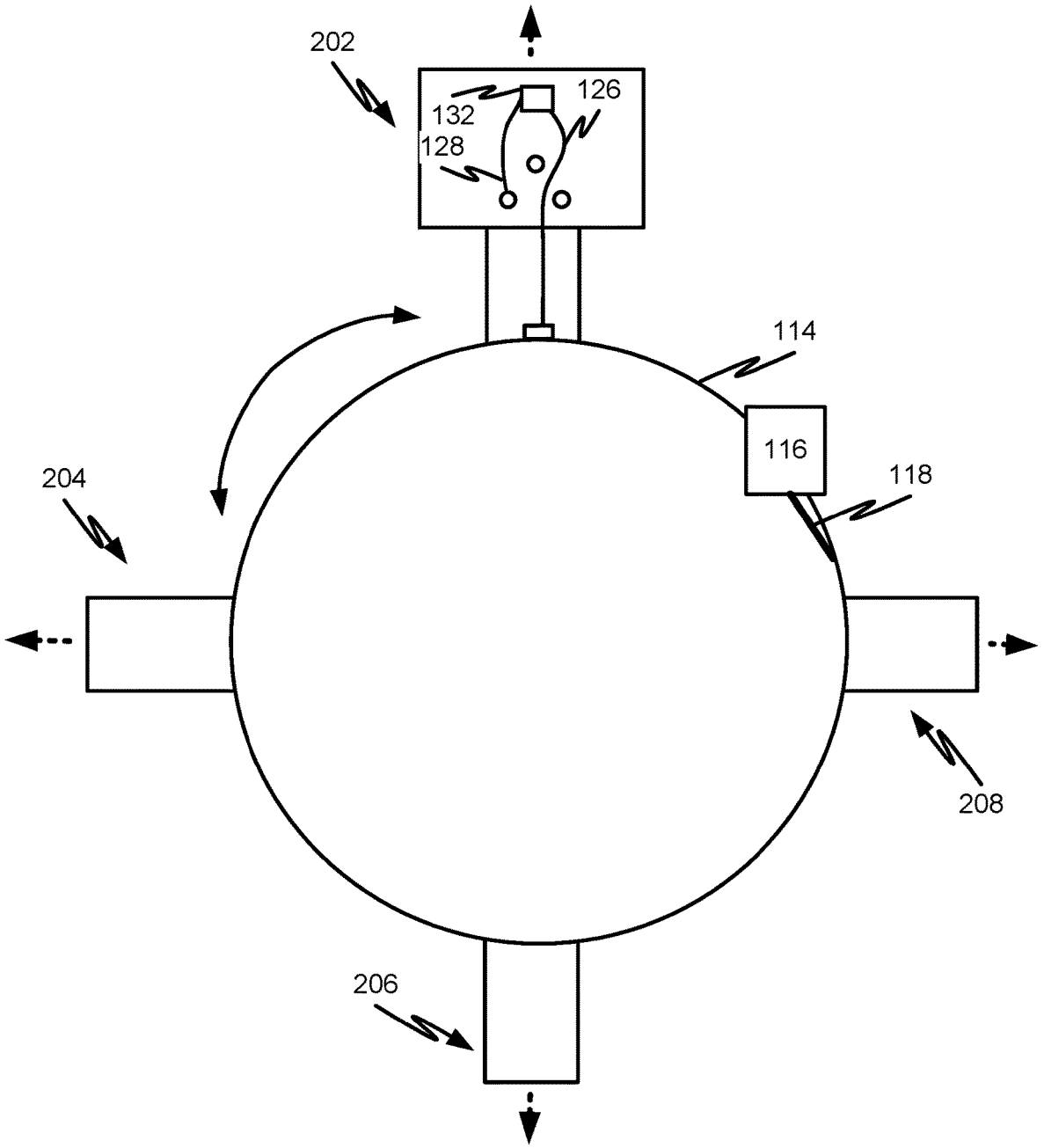
FIG. 2 is a diagram of an example ceiling fan having lighted blades showing details of rotating contact plate in accordance with some implementations.

FIG. 2 shows the positive voltage plate 114 in greater detail. For example, FIG. 2 shows the positive voltage plate 114 and the positive voltage plate contact 118 that rides on and creates an electrical connection to the positive voltage plate 114 when the positive voltage plate 114 is moving or not moving. The positive voltage plate contact 118 is mounted via the positive voltage plate contact mounting bracket 116. Details of one of the fan blades 202 are shown. The fan blade 202 includes one or more lights 132 that are connected to the negative side of the electrical power via a negative conductor 128 (wire, conductive trace, etc.) and to a positive side of the electrical power via a positive conductor 126 (wire, conductive trace, etc.) connected to the positive voltage plate 114. One or more of the components shown in the detail of blade 202 can be replicated in whole or in part for the other blades (204-208).

It is, therefore, apparent that there is provided, in accordance with the various implementations disclosed herein, ceiling fans having lighted blades.

While the disclosed subject matter has been described in conjunction with a number of embodiments, it is evident that many alternatives, modifications and variations would be, or are, apparent to those of ordinary skill in the applicable arts. Accordingly, Applicant intends to embrace all such alternatives, modifications, equivalents and variations that are within the spirit and scope of the disclosed subject matter.

What is claimed is:

1. A ceiling fan comprising:

a power supply constructed to supply direct current electrical power via a negative lead and a positive lead;

a conductive frame connected to a down rod, wherein the negative lead is connected to the conductive frame;

a positive voltage plate;

a positive voltage plate contact connected to the positive lead, wherein the positive voltage plate contact is stationary and contacts the positive voltage plate while the positive voltage plate rotates;

a rotating portion having a conductive housing connected to the down rod, the rotating portion being coupled to, and electrically insulated from, the positive voltage plate and one or more conductive fan blade brackets electrically connected to the negative lead via the conductive housing of the rotating portion, wherein when the rotating portion rotates, the positive voltage plates rotates; and one or more lights disposed on a fan blade, wherein each light is connected to a respective conductive fan blade bracket and to the positive voltage plate such that a negative side of the direct current electrical power is supplied through the conductive fan blade bracket and a positive side of the direct current electrical power is supplied through the positive voltage plate.

2. The ceiling fan of claim 1, further comprising a switch to switch the positive voltage from the power supply to the positive voltage plate.

3. The ceiling fan of claim 1, further comprising a control circuit operable to control the one or more lights.

* * * * *